US006488366B1

(12) United States Patent
Potochnik et al.

(10) Patent No.: US 6,488,366 B1
(45) Date of Patent: Dec. 3, 2002

(54) FLUID EJECTING DEVICE WITH ANCHOR GROOVES

(75) Inventors: Stephen J. Potochnik, Corvallis, OR (US); Chien-Hua Chen, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 10/003,173

(22) Filed: Oct. 31, 2001

(51) Int. Cl.[7] ..... B41J 2/05
(52) U.S. Cl. ..... 347/65; 347/67
(58) Field of Search ..... 347/20, 40, 42, 347/44, 45, 54, 56, 61, 63, 84, 87

(56) References Cited

U.S. PATENT DOCUMENTS 6,033,581 A * 3/2000 Kobayashi ..... 216/27

* cited by examiner

*Primary Examiner*—John Barlow
*Assistant Examiner*—Juanita Stephens

(57) ABSTRACT

A method of forming a fluid drop emitting apparatus such as an ink jet printing device that includes forming a portion of a fluid drop generator structure on a first surface of a substrate, forming narrow slots in a second surface of the substrate, and etching the narrow slots to form anchor grooves.

9 Claims, 6 Drawing Sheets

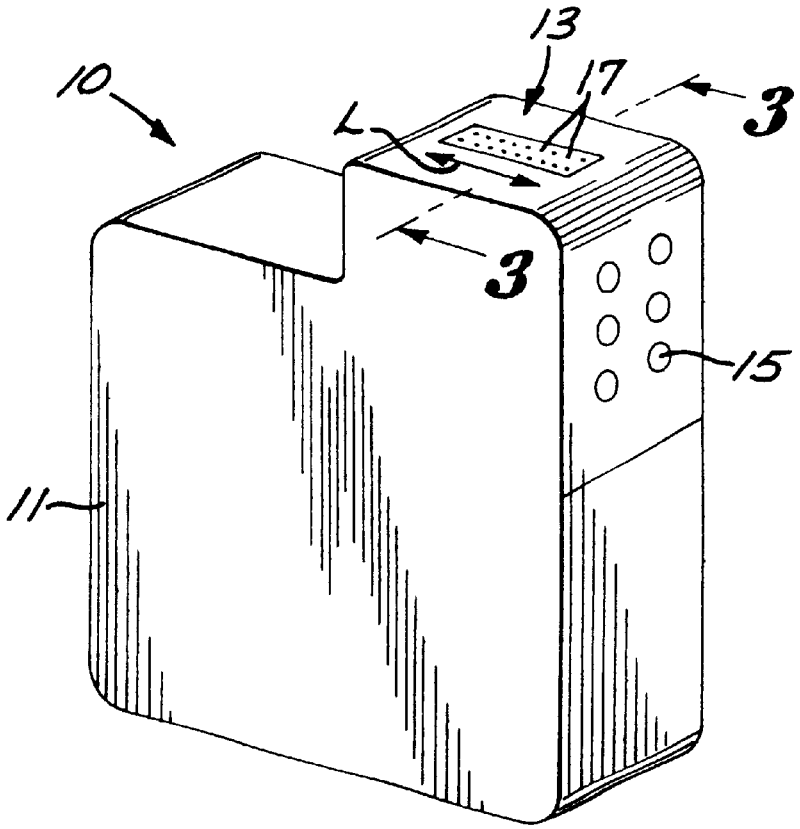
FIG. 1
FIG. 2
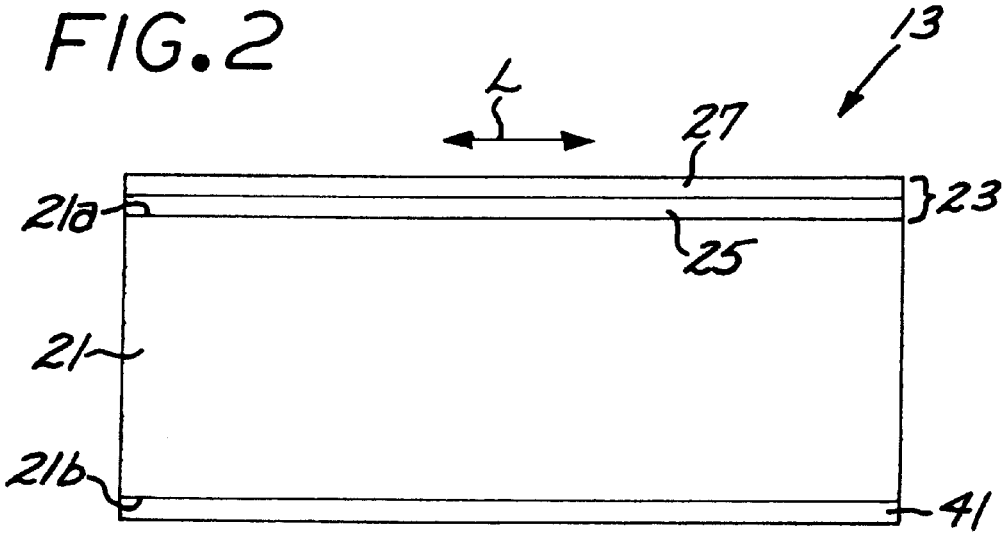

FLUID EJECTING DEVICE WITH ANCHOR GROOVES

BACKGROUND OF THE DISCLOSURE

The disclosed invention relates generally to fluid ejecting devices such as ink jet printing devices, and more particularly to a fluid ejecting device having adhesive retaining anchor grooves formed in a portion thereof that is adhesively attached to a cartridge body.

The art of inkjet printing is relatively well developed. Commercial products such as computer printers, graphics plotters, and facsimile machines have been implemented with ink jet technology for producing printed media. The contributions of Hewlett-Packard Company to ink jet technology are described, for example, in various articles in the *Hewlett-Packard Journal,* Vol. 36, No. 5 (May 1985); Vol. 39, No. 5 (October 1988); Vol. 43, No. 4 (August 1992); Vol. 43, No. 6 (December 1992); and Vol. 45, No. 1 (February 1994); all incorporated herein by reference.

Generally, an ink jet image is formed pursuant to precise placement on a print medium of ink drops emitted by an ink drop generating device known as an ink jet printhead. Typically, an ink jet printhead is attached to a print cartridge body that is, for example, supported on a movable print carriage that traverses over the surface of the print medium. The ink jet printhead is controlled to eject drops of ink at appropriate times pursuant to command of a microcomputer or other controller, wherein the timing of the application of the ink drops is intended to correspond to a pattern of pixels of the image being printed.

A typical Hewlett-Packard ink jet printhead includes an array of precisely formed nozzles in an orifice structure that is attached to or integral with an ink barrier structure that in turn is attached to a thin film substructure that implements ink firing heater resistors and apparatus for enabling the resistors. The ink barrier structure defines ink channels including ink chambers disposed over associated ink firing resistors, and the nozzles in the orifice structure are aligned with associated ink chambers. Ink drop generator regions are formed by the ink chambers and portions of the thin film substructure and the orifice structure that are adjacent the ink chambers.

A consideration with ink jet printheads is the reliability of the attachment of a printhead to a print cartridge body.

BRIEF DESCRIPTION OF THE DRAWINGS

The advantages and features of the disclosed invention will readily be appreciated by persons skilled in the art from the following detailed description when read in conjunction with the drawing wherein:

FIG 1 is a schematic perspective view of a print cartridge that can incorporate an ink jet printhead in accordance with the invention.

FIG. 2 is a schematic side elevational view of the printhead.

DETAILED DESCRIPTION OF THE DISCLOSURE

Figure 3A:
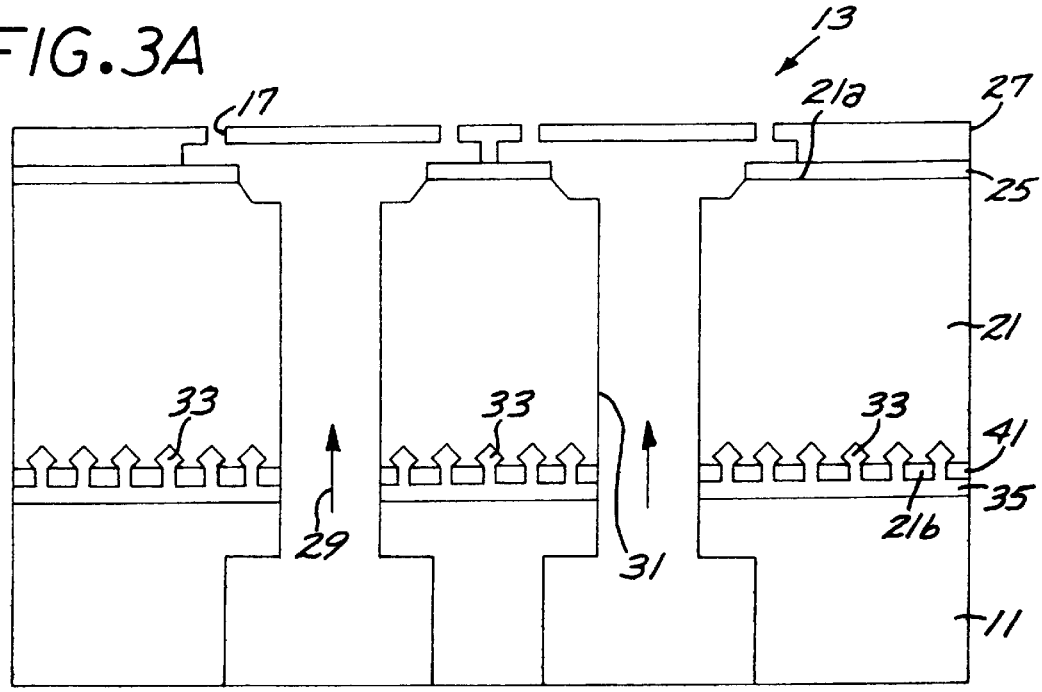
FIG. 3A is a schematic transverse cross-sectional view of the printhead.

FIG. 1 is a schematic perspective view of one type of ink jet print cartridge 10 that can incorporate fluid drop ejecting apparatus of the present invention. The print cartridge 10 includes a cartridge body 11, a printhead 13, and electrical contacts 15. The cartridge body 11 contains ink or other suitable fluid that is supplied to the printhead 13, and electrical signals are provided to the contacts 15 to individually energize ink drop generators to eject a droplet of fluid from a selected nozzle 17. The print cartridge 10 can be a disposable type that contains a substantial quantity of ink within its body 11. Another suitable print cartridge may be of the type that receives ink from an external ink supply that is mounted on the print cartridge or fluidically connected to the print cartridge by a conduit such as a tube.

While the disclosed structures are described in the context of ink drop jetting, it should be appreciated that the disclosed structures can be employed for drop jetting of other fluids.

Referring to FIGS. 2 and 3A, the printhead 13 includes a silicon substrate 21 and a fluid drop generator substructure 23 formed on a front surface 21*a* of the silicon substrate 21. The fluid drop generator substructure 23 implements for example a thermal ink drop jetting substructure that includes thermal ink drop generators. An ink drop generator includes for example a heater resistor, a firing chamber, and a nozzle. By way of illustrative example, the printhead 13 has a longitudinal extent along a longitudinal reference axis L and the nozzles 17 can be arranged in columnar arrays aligned with the reference axis L.

The fluid drop generator substructure 23 includes, for example, an integrated circuit thin film stack 25 of thin film layers that implements ink drop firing heater resistors and associated electrical circuitry such as drive circuits and addressing circuits. Disposed on the thin film stack 25 is an ink channel and orifice substructure 27 that embodies ink firing chambers, ink channels, and the nozzles 17. The ink channel and orifice structure 27 can be an integral structure made of a photodefinable spun-on epoxy called SU8. Alternatively, the ink channel and orifice structure 27 can be a laminar structure comprised of an ink barrier layer and an orifice plate.

Ink 29 is conveyed from a reservoir in the cartridge body 11 to the fluid drop generator substructure 23 by one or more ink feed slots 31 formed in the silicon substrate 21. Alternatively, ink can be conveyed around the edges of the substrate 21. Each ink feed slot 31 extends along the longitudinal axis L of the printhead, and ink drop generators can be disposed on one or both sides of the elongated ink feed slot 31. Each ink feed slot 31 further extends from a back surface of an oxide surface 41 disposed on the back surface 21*b* of the silicon substrate 21 to the front surface 21*a* of the silicon substrate 21.

The printhead 13 further includes micromachined anchor grooves 33 formed in a portion of the silicon substrate adjacent to the back surface 21*b* thereof and in the oxide layer 41. The printhead is attached to the cartridge body by an adhesive 35 that partially or fully fills the anchor grooves 33, and forms an adhesion layer between the oxide layer 41 and the cartridge body 11. The adhesive 35 and the anchor grooves 33 form an interlock structure that can improve the adhesion between the printhead and the cartridge body.

Figure 3B:
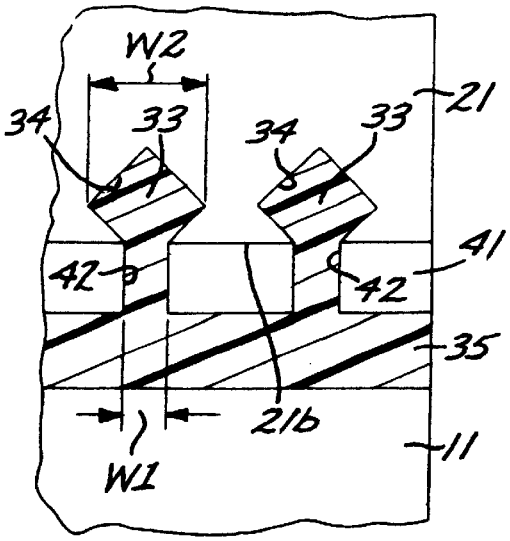
FIG. 3B is a cross-sectional view illustrating anchor grooves of the printhead.
Figure 3C:
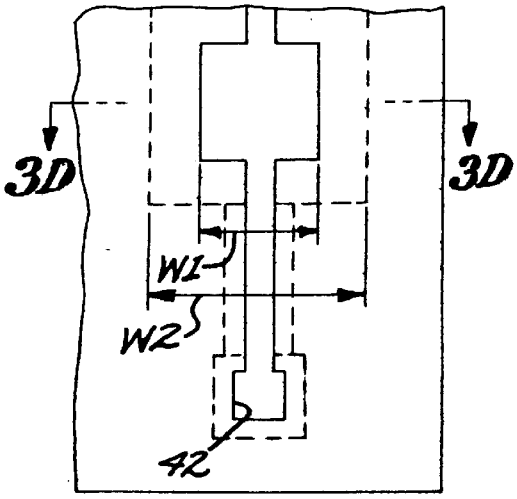
FIG. 3C is a plan view depicting a portion of an example of an anchor groove of the printhead.
Figure 3D:
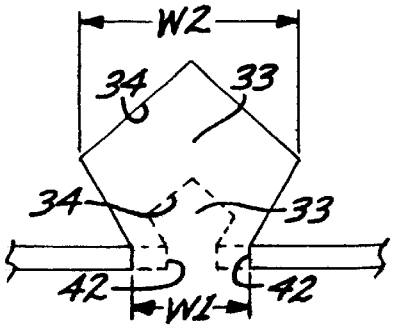
FIG. 3D is a detail cross-sectional view of the anchor groove of FIG. 3C.

As shown in FIGS. 3B–3D, each anchor groove 33 more particularly comprises an expanded anchor cavity 34 in the silicon substrate adjacent to the back surface 21*b* of the silicon substrate and an entrance opening 42 that extends between the expanded cavity 34 and the back surface of the oxide layer 41 that forms an adhesive interface surface. The expanded anchor cavity 34 has a maximum width W2 that is greater than a corresponding minimum width W1 of the entrance opening 42. In other words, the cavity width W2 is greater than the correspondingly located opening width W1. The entrance opening is more particularly formed in the oxide layer 41 and in the back surface 21*b* of the the substrate 21. For example, the expanded cavity 34 of each anchor groove 33 can be generally diamond shaped in cross section and includes walls that diverge with distance from the opening of the anchor groove at the back surface of the oxide layer. More generally, each anchor groove 33 comprises a groove or slot that has a maximum interior width W2 that is larger than the minimum width W1 of the entrance opening of the groove, wherein the entrance opening extends between an adhesion surface of the printhead and the anchor cavity 34. Such adhesive interface surface comprises the back surface of oxide layer 41 or the back surface 21*b* of the silicon substrate if the oxide layer 41 is omitted.

As depicted in FIGS. 3C and 3D, an anchor groove 33 can have different opening widths W1 and corresponding cavity widths W2 along its length, for example to facilitate adhesive penetration into the anchor grooves or to improve adhesive coupling of the printhead to the cartridge body I1. In other words, an anchor groove 33 can have sections or portions of different opening widths W1 and cavity widths W2.

Figure 4A:
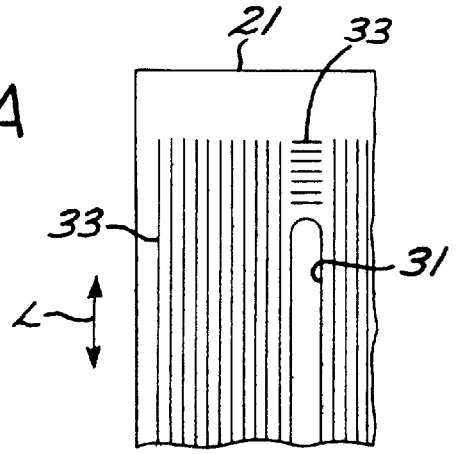
FIG. 4A is a schematic plan view illustrating arrangements of anchor grooves of the printhead.
Figure 4B:
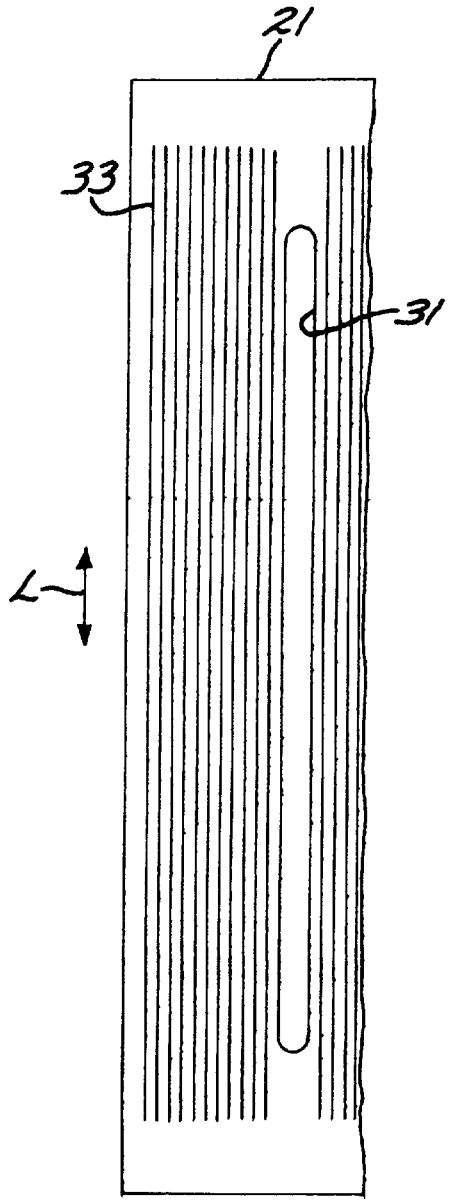
FIG. 4B is a schematic plan view illustrating a further arrangement of anchor grooves of the printhead.

The anchor grooves 33 can be of different lengths and can be arranged in a variety of ways. For example, as shown in FIG. 4A, a plurality of anchor grooves can be arranged in offset columns of anchor grooves that are substantially parallel to the longitudinal reference axis L. Anchor grooves can also be oriented substantially orthogonally to the longitudinal reference axis L, for example in a region at an end of an ink feed slot 31. Anchor grooves can further extend along most of the longitudinal extent of the printhead, as shown in FIG. 4B.

FIGS. 5–11 show examples of various steps that can be used to fabricate the printhead of FIGS. 2–3.

Figure 5:
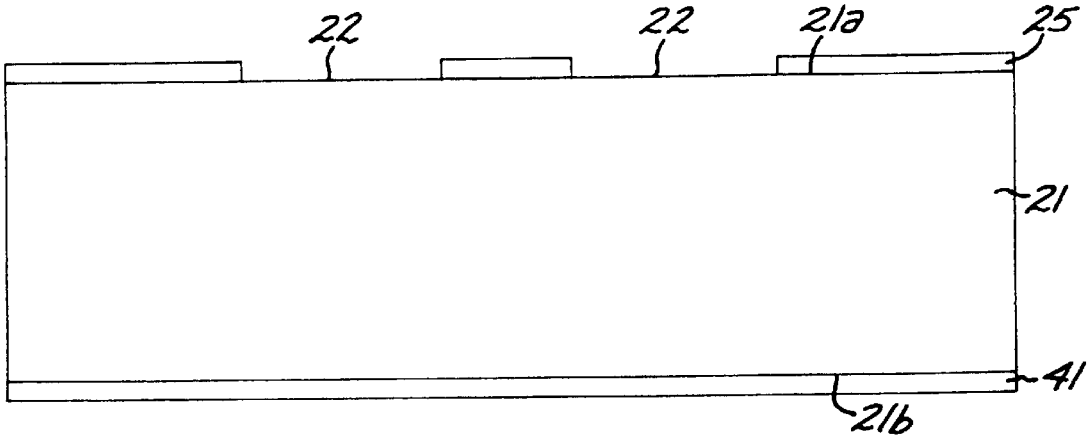
FIGS. 5, 6, 7, 8, 9, 10 and 11, are schematic transverse cross-sectional views illustrating various stages in the manufacture of the printhead.

In FIG. 5, an integrated circuit thin film stack 25 of thin film layers including heater resistors, for example, is formed on a front surface 21*a* of a silicon substrate 21 having a <100> crystalline orientation, and an oxide layer 41 is formed on a back surface 21*b* of the silicon substrate 21. The thin film stack 25 and the oxide layer 41 can be formed, for example, by integrated circuit techniques. The oxide layer 41 can alternatively be replaced by a suitable masking material such as silicon carbide or silicon nitride. The thin film stack 25 can be patterned so that selected regions 22 of the top surface 21*a* of the silicon substrate 21 are exposed. These exposed regions 22 include regions where ink feed slots can be formed as described further herein. Alternatively, the thin film stack 25 can cover substantially all of the entire front surface 21 a of the silicon substrate 21.

Figure 6:
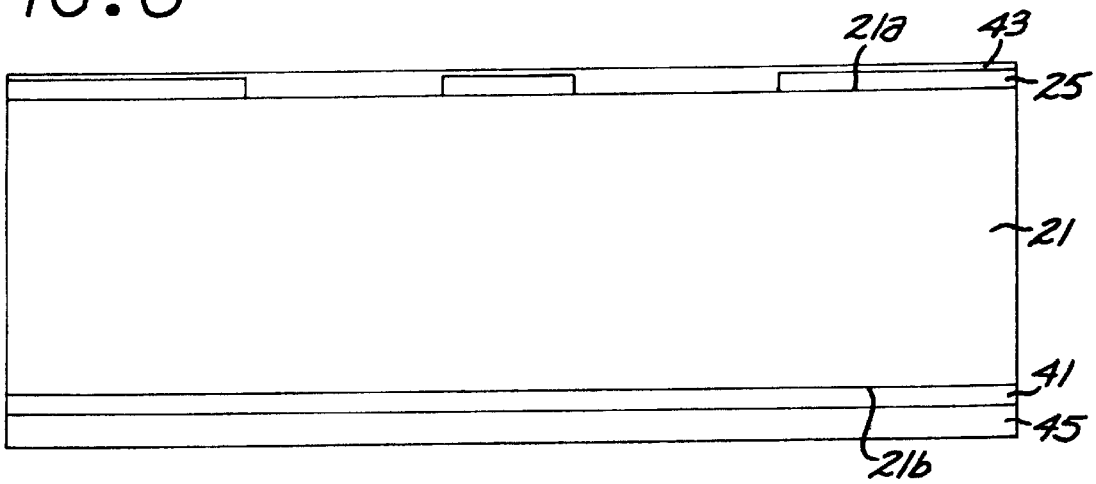

In FIG. 6, a photoresist layer 43 is applied over the thin film stack 25 and the exposed regions 22 of the top surface 21*a*, and a photoresist layer 45 is applied over the oxide layer 41.

Figure 7:
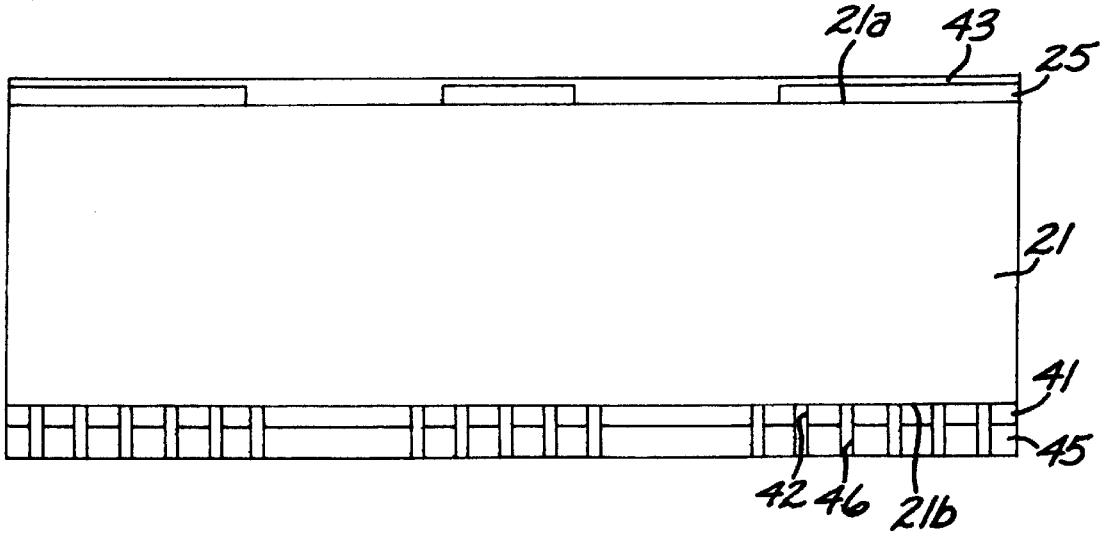

In FIG. 7, narrow openings 46 are formed in the photoresist layer 45, and narrow openings 42 are formed in the oxide layer 41 in alignment with corresponding openings 46 in the photoresist layer 45.

Figure 8:
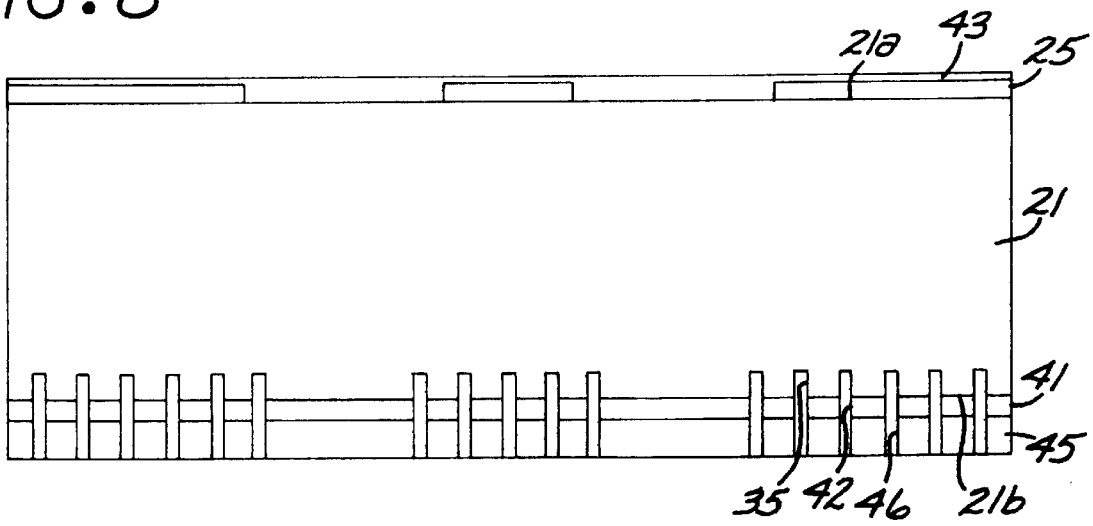

In FIG. 8, the back surface 21*b* of the silicon substrate 11 is subjected to a subtractive etching process, such as deep reactive ion etching (DRIE), to form narrow slots 33' in the silicon substrate 21. By way of illustrative example, deep reactive ion etching is accomplished using a polymer deposition dry etch process. The narrow slots 35' can have generally vertical walls.

Alternatively, the narrow slots 35' can be formed by laser ablation.

Figure 9:
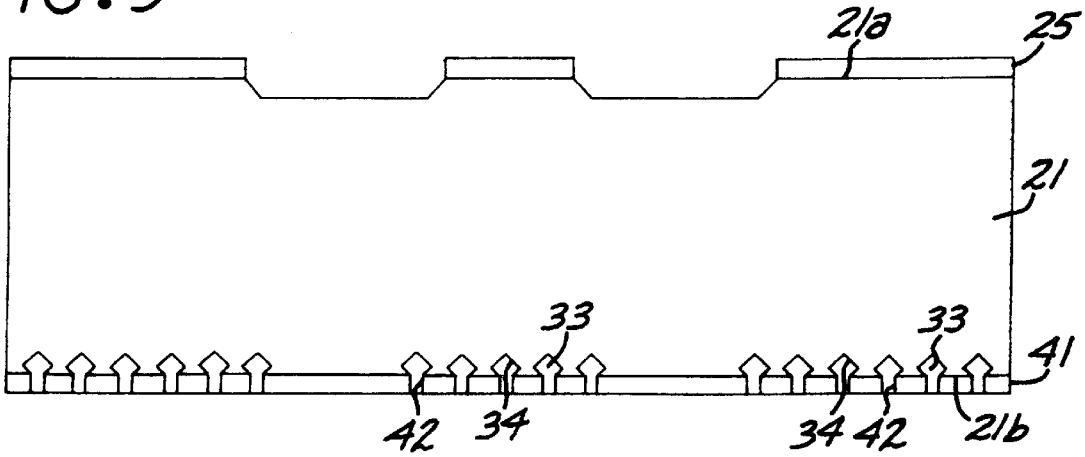

The photoresist layers 43, 45 are removed, and the substrate 21 is subjected to a wet etch such as TMAH or KOH to form trenches 47 in the exposed regions of top surface 21*a* of the silicon substrate 21, and to form expanded cavities 34 of micromachined anchor grooves 33 in the back surface 21*b* of the silicon substrate 21, as shown in FIG. 9. The selective anisotropic wet etch achieves a re-entrant cross-sectional profile that is generally diamond shaped.

Figure 10:
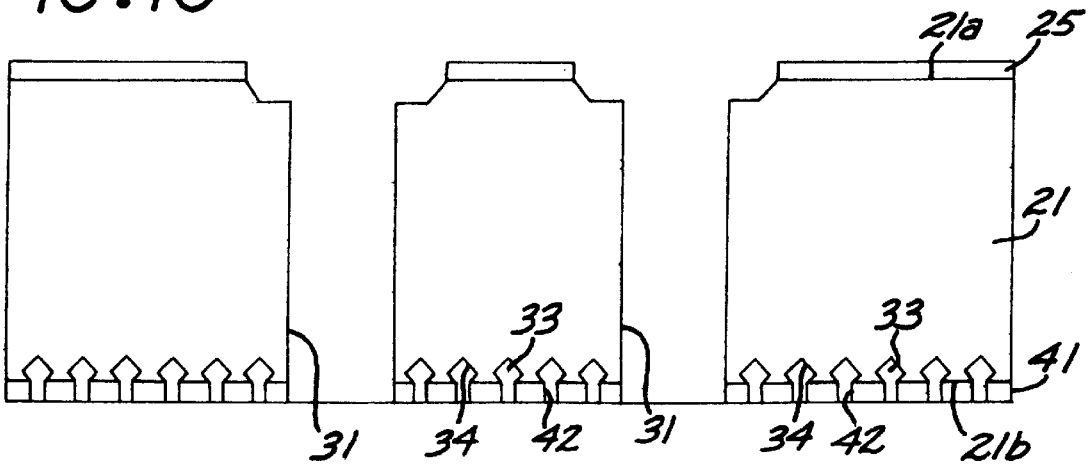

In FIG. 10, ink feed slots 31 are formed in the silicon substrate, for example by abrasive blasting, chemical etching or laser ablation.

Figure 11:
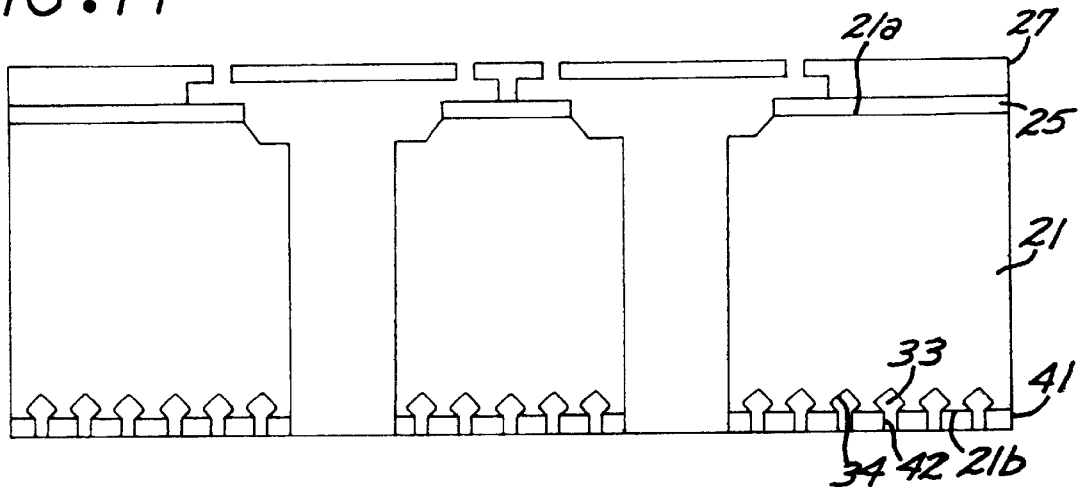

In FIG. 11, an ink channel and orifice structure 27 is formed on the integrated circuit thin film stack 25. The printhead can then be attached to a print cartridge body with adhesive.

Figure 12:
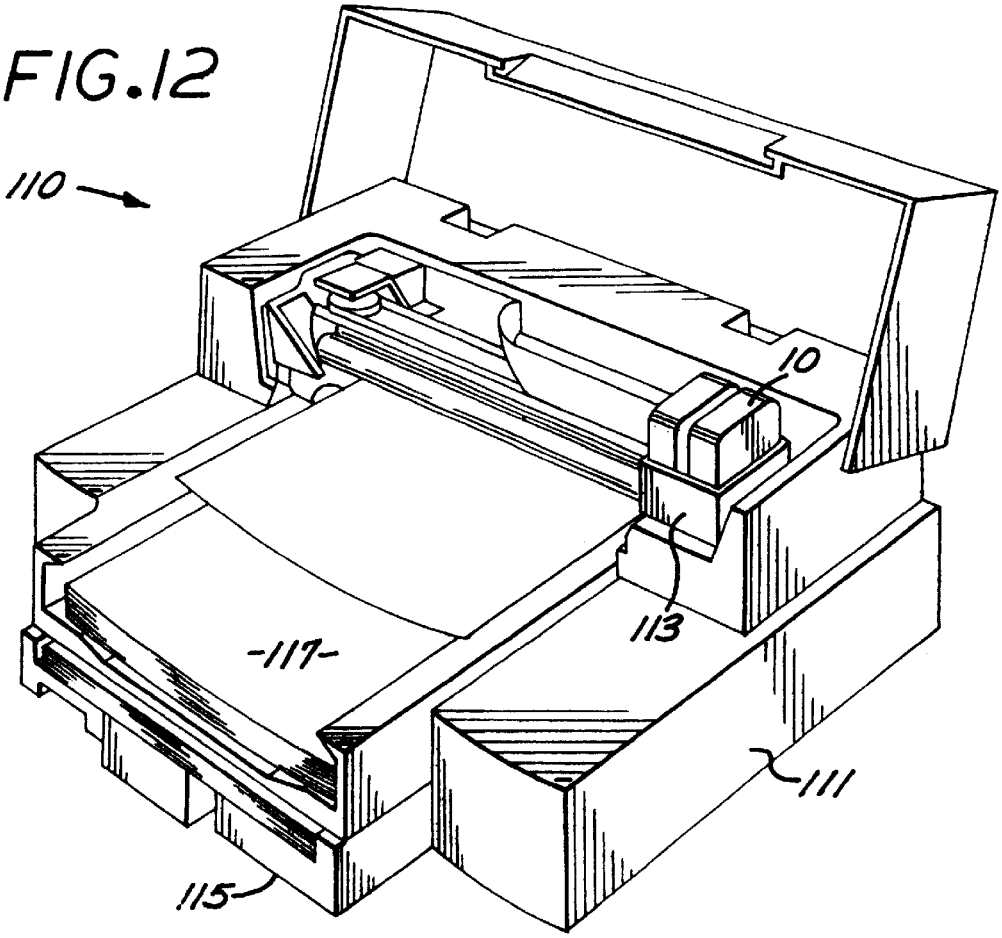
FIG. 12 depicts an example of a printing system that can employ the printhead.

FIG. 12 is a perspective view of an exemplary implementation of an ink jet printing system 110 in which the disclosed print cartridge 10 can be employed. The printing system 110 includes a printer portion 111 having at least one print cartridge 10 installed in a scanning carriage 113. The printer portion 111 includes a media tray 115 for receiving print media 117. As a sheet of print media is stepped through a print zone in the printer portion 111, the scanning carriage moves the print cartridge(s) 10 across the print media. The printer portion 111 selectively activates drop generators of the printhead of the print cartridge 10 to deposit ink on the print media to thereby accomplish printing.

The foregoing has thus been a disclosure of a fluid drop emitting device that is useful in ink jet printing as well as other drop emitting applications such as medical devices, and techniques for making such fluid drop emitting device.

Although the foregoing has been a description and illustration of specific embodiments of the invention, various modifications and changes thereto can be made by persons skilled in the art without departing from the scope and spirit of the invention as defined by the following claims.

What is claimed is:

1. A fluid ejecting device comprising:

a substrate;

a fluid drop generator structure formed on a first surface of said substrate; and a plurality of anchor grooves formed in a second surface of said substrate, each of said anchor grooves including an anchor cavity and an opening extending between said anchor cavity and said second surface, and wherein a maximum width of said anchor cavity is greater than a minimum width of said opening.

2. The fluid ejecting device of claim 1 wherein said fluid drop generator structure comprises a thermal drop jetting structure.

3. The fluid ejecting device of claim 1 wherein said anchor cavity has a generally diamond shaped cross-section.

4. The fluid ejecting device of claim 1 wherein said substrate comprises a silicon substrate having a <100> crystalline orientation.

5. The fluid ejecting device of claim 3 wherein said anchor cavity is formed by wet etching.

6. An ink jet printhead comprising:

a silicon substrate having a <100> crystalline orientation;

a fluid drop generator structure formed on a first surface of said silicon substrate; and a plurality of anchor grooves formed in a second surface of said silicon substrate, each of said anchor grooves including an anchor cavity and an opening extending between said anchor cavity and said second surface, and wherein a maximum width of said anchor cavity is greater than a minimum width of said opening.

7. The inkjet printhead of claim 6 wherein said fluid drop generator structure comprises a thermal drop jetting structure.

8. The ink jet printhead of claim 6 wherein said anchor cavity has a generally diamond shaped cross-section.

9. The ink jet printhead of claim 6 wherein said cavity is formed by wet etching.

* * * * *